US007522739B2

(12) United States Patent
Rass et al.

(10) Patent No.: US 7,522,739 B2
(45) Date of Patent: Apr. 21, 2009

(54) HEARING AID WITH A SWITCHING DEVICE FOR SWITCHING ON AND OFF AND CORRESPONDING METHOD

(75) Inventors: Uwe Rass, Nürnberg (DE); Riku Sinikallio, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 571 days.

(21) Appl. No.: 11/126,088

(22) Filed: May 10, 2005

(65) Prior Publication Data

US 2005/0254676 A1 Nov. 17, 2005

(30) Foreign Application Priority Data

May 11, 2004 (DE) ..... 10 2004 023 049

(51) Int. Cl.
*H04R 25/00* (2006.01)

(52) U.S. Cl. ..... 381/323; 381/60; 381/312; 381/318; 381/321; 381/328

(58) Field of Classification Search ..... 381/318, 381/56, 60, 320, 324, 104, 107, 312, 321, 381/323, 328; 73/587
See application file for complete search history.

(56) References Cited

U.S. PATENT DOCUMENTS 4,955,729 A * 9/1990 Marx ..... 381/322
5,187,746 A * 2/1993 Narisawa ..... 381/323
7,151,838 B2 * 12/2006 Galler et al. ..... 381/312
7,406,179 B2 * 7/2008 Ryan ..... 381/328
2002/0057805 A1 * 5/2002 Kato et al. ..... 381/56
2004/0008854 A1 * 1/2004 Sauer ..... 381/321
2005/0226446 A1 * 10/2005 Luo et al. ..... 381/312

FOREIGN PATENT DOCUMENTS

DE 36 42 828 A1 8/1987
DE 38 04 526 C1 10/1988
EP 1 301 060 A1 4/2003
JP 11-275694 A 10/1999

* cited by examiner

*Primary Examiner*—Curtis Kuntz
*Assistant Examiner*—Jesse A Elbin

(57) ABSTRACT

It is intended that the switching on and off of a hearing aid (I) should be made more user-friendly. To this end the hearing aid (I) is fitted with a temperature sensor (TS) to detect the body heat of the hearing aid wearer and therefore that the hearing aid is inserted in the auditory canal. The hearing aid is then switched on and off again based on the temperature signal. As an alternative to the temperature sensor, it is possible to use a pressure sensor to detect contact pressure of the hearing aid housing on the auditory canal, a resistance sensor to detect an electrical load resistance as a function of volume or an acoustic sensor to detect a sound level. It is also possible to switch the hearing aid (I) on and off wirelessly using a remote control.

15 Claims, 1 Drawing Sheet

HEARING AID WITH A SWITCHING DEVICE FOR SWITCHING ON AND OFF AND CORRESPONDING METHOD

CROSS REFERENCE TO RELATED APPLICATIONS

This application claims priority to the German application No. 10 2004 023 049.8, filed May 11, 2004 which is incorporated by reference herein in its entirety.

FIELD OF INVENTION

The present invention relates to a hearing aid unit with a switching device for switching the hearing aid on and off. The present invention also relates to a corresponding method for switching a hearing aid on and off.

BACKGROUND OF INVENTION

A battery compartment switch is frequently used to switch hearing aids on and off. The battery compartment can be opened to a latch position, thereby breaking the electric circuit. Such battery compartments are relatively susceptible to error and require a lot of space in the hearing aid housing. It is also extremely difficult to achieve a watertight seal.

In addition to these battery compartment switches, standard switches and buttons are of course also used to switch hearing aids on and off. These standard switching devices however have the disadvantage that they require a large amount of space in the hearing aid housing.

A remotely controlled hearing aid is known from DE 36 42 828 C3, which can be switched on and off using an external control device. A remote control can therefore be used to switch the hearing aid on and off.

A method is also known from EP 1 301 060 A1 for detecting acoustic parameters for the adjustment of hearing aids. With the known method the acoustic parameters of the ear are determined by measuring the impedance of the auditory canal.

An automatic hearing aid switch is also known from the publication FR 27 0088 7 A3. This operates on a magnetic basis. If an object containing a magnet moves into the vicinity of the hearing aid, the hearing aid is switched accordingly.

A hearing aid with a sensor circuit is also known from the publication DE 38 04 526 C, which is switched on upon insertion into the auditory canal. The electrical connection is thereby measured between two sensor arcs.

The Japanese publication JP 11 27 56 94 A also describes a hearing aid that can be switched on and off using an infrared sensor. As soon as the hearing aid is inserted into the auditory canal, the infrared sensor detects a corresponding signal and switches the hearing aid on.

SUMMARY OF INVENTION

The said sensors are however relatively expensive, sensitive to interference or require additional objects for switching purposes.

An object of the present invention is therefore to improve or simplify the automatic switching on and off of hearing aids.

According to the invention this object is achieved by a hearing aid unit with a switching device for switching the hearing aid on and off, the switching device having one or more of the, following devices: a temperature sensor to detect the body heat of a hearing aid wearer, a pressure sensor to detect contact pressure of the hearing aid housing on the auditory canal, a resistance sensor to detect an electrical load resistance as a function of volume, an acoustic sensor to detect a sound level, a remote control for the wireless transmission of a switch signal.

The invention also provides for a method for switching a hearing aid on and off, by obtaining a switch signal from one or a plurality of the following signals: a temperature signal relating to the body heat of a hearing aid wearer, a pressure signal relating to contact by the hearing aid housing on the auditory canal of a hearing air wearer, a resistance signal relating to an electrical load resistance as a function of volume, an acoustic signal relating to an input level, a remote control signal.

The advantage of the solution according to the invention is that there is no need for a mechanical switch, e.g. the battery compartment switch. The battery compartment switch is generally very difficult to operate, in particular for hearing aid wearers with impaired motor functions. Automatic switching on and off therefore represents a significant increase in user-friendliness.

With the hearing aid unit according to the invention a switch-on signal is preferably first generated from the sensor signal based on a first threshold value and a switch-off signal based on a second threshold value. The use of two threshold values results in an improved switching response in the area of the threshold values.

With a particular development of the hearing aid unit according to the invention, the switching on and off operations include switching to or from standby mode. This mode extends the useful life or endurance of the hearing aid battery during normal operation.

A time signal can also be taken into account when generating a switch signal. This is particularly advantageous, if the hearing aid is to switch off automatically. Generally this should only happen when a specific criterion, for example a very low acoustic input level, has been detected for a certain period.

Advantages also result from the use of a rechargeable battery, as this can be integrated permanently in the housing of the hearing aid and charged via contacts in the aid. There is then no need for either the switch or the battery compartment.

It is also favorable for the hearing aid housing to be of a watertight design. This is possible when rechargeable batteries are used, which do not require oxygen to operate. In this case there is no need, as mentioned above, for the battery compartment, which generally represents a weak point with regard to the leak-tightness problem.

BRIEF DESCRIPTION OF THE DRAWINGS

The present invention is described below with reference to the accompanying drawings, in which.

The exemplary embodiments described below represent preferred embodiments of the present invention.

DETAILED DESCRIPTION OF INVENTION

Figure 1:
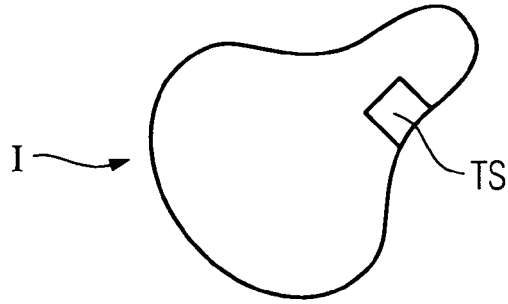
FIG. 1 shows a temperature or pressure sensor in an in-the-ear (ITE) hearing aid.

FIG. 1 shows a schematic diagram of an in-the-ear hearing aid I. It has a temperature sensor TS. When worm, the hearing aid I or its shell heats up. The temperature sensor TS registers this heat. Once a certain temperature threshold is exceeded, the device is switched on. If the temperature drops back to below a lower temperature threshold, the hearing aid I switches off again. This temperature-controlled switching on and off is also possible in principle with a single temperature threshold.

Alternatively the sensor TS shown in FIG. 1 could also be configured as a pressure sensor. This pressure sensor, in the hearing aid housing in in-the-ear hearing aids or in the molded earpiece in other types of hearing aid, identifies whether the device is in the ear and switches it on or off accordingly. The pressure sensor thereby responds to the pressure of the wall of the hearing aid housing or molded earpiece on the auditory canal. The pressure sensor can be in the form of a piezo-element, which converts pressure signals to electrical signals.

Figure 2:
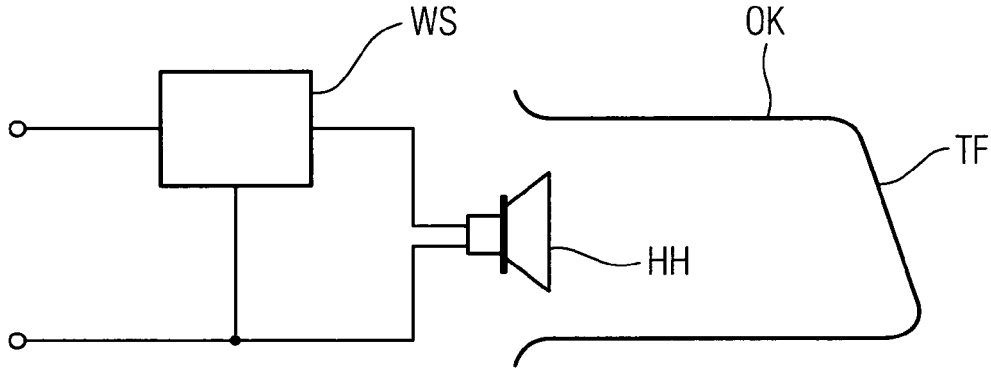
FIG. 2 shows a basic circuit diagram for resistance measurement as a function of load.

It can also be determined electrically whether or not a hearing aid is located in the auditory canal OK. This is achieved for example according to FIG. 2, by monitoring the complex resistance of the hearing aid receiver HH as a function of load and frequency. Monitoring takes place by means of a resistance sensor WS. The volume enclosed by the hearing aid receiver HH in the auditory canal OK in front of the eardrum TF, into which the receiver HH emits the sound, is thereby measured as the load. To this end a resistance sensor WS is connected to the receiver HH and integrated in the hearing aid. The level and phase of the current through the receiver HH change as a function of the volume, into which the receiver emits the sound. This effective volume is smaller when the hearing aid is worn than when the hearing air is not worn. Therefore the impedance change when the hearing aid is inserted can be used as a switch signal.

It is also possible to determine acoustically whether or not the hearing aid is in use. If the acoustic input level remains below a threshold for quite a long period, this indicates that the hearing aid is not in use or is not being worn. It can therefore be switched to standby mode or completely switched off in order to save energy. In standby mode it is possible to resume hearing aid processing quickly when an acoustic signal is once again present. No additional sensor system is necessary for this automatic switch based on acoustic input level. Instead the structural elements, which are already present in the hearing aid, can also be used for this acoustic analysis.

Figure 3:
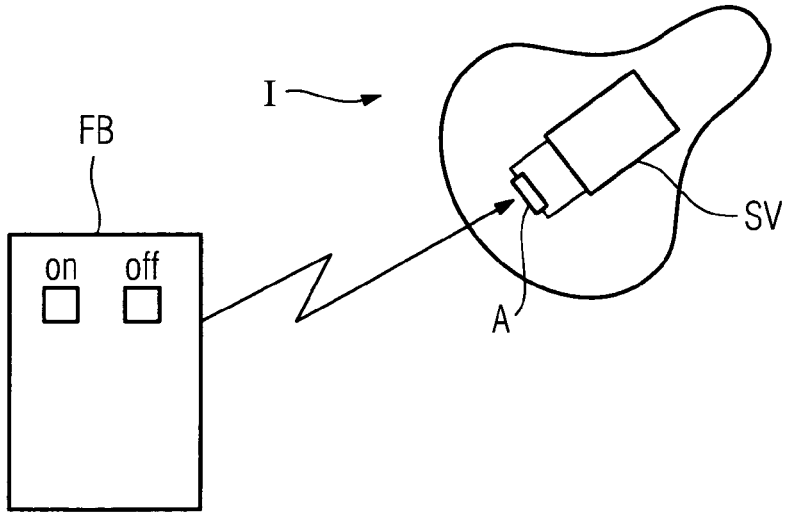
FIG. 3 shows an in-the-ear hearing aid with remote control.

The hearing aid I can also be switched on and off, as shown in FIG. 3, wirelessly using a remote control FB. To this end the signal processor SV in the hearing aid I has an antenna A. When the "off" button on the remote control FB is operated, the hearing aid I switches to power-saving standby mode, in which it is possible to receive and process the signal to switch on. Operating the "on" button switches the hearing aid back on.

The invention claimed is:

1. A hearing aid, comprising a switching device for switching the hearing aid on and off, wherein:

the switching device includes a resistance sensor for detecting an electrical load resistance, a value of the electrical load resistance being determined by a size of the volume into which the hearing aid emits sound, wherein a first size of the volume is defined upon insertion of the hearing aid into an auditory canal of an user wearing the hearing aid, and a second size of the volume is defined upon deinsertion of the hearing aid from the auditory canal of the user, and the switching device is adapted to automatically switch on and off the hearing aid based on the respective value of the electrical load resistance resulting upon insertion and deinsertion of the hearing aid relative to the auditory canal of the user.

2. The hearing aid according to claim 1, wherein the switching device further comprises an element chosen from the group consisting of a heat flow sensor for detecting a body heat of a hearing aid user, a pressure sensor for detecting a contact pressure of a housing of the hearing aid against an auditory canal of a hearing aid user, an acoustic sensor for detecting a sound level and a remote control for wirelessly transmitting a switching signal to the hearing aid.

3. The hearing aid according to claim 2, wherein a switch-on signal for switching on the hearing aid is generated based on a first threshold value and a switch-off signal for switching off the hearing aid is generated based on a second threshold value, the first and second threshold values related to a physical value associated with the element.

4. The hearing aid according to claim 1, wherein a switch-on signal for switching on the hearing aid is generated based on a first threshold value and a switch-off signal for switching off the hearing aid is generated based on a second threshold value, the first and second threshold values related to the electrical load resistance.

5. The hearing aid according to claim 1, wherein switching on and off the hearing aid by the switching device includes switching the hearing aid from an operating mode to a stand by mode and from a stand by mode to an operating mode.

6. The hearing aid according to claim 1, wherein switching on and off the hearing aid by the switching device is based on a time signal.

7. The hearing aid according to claim 1, further including a housing for accommodating the hearing aid.

8. The hearing aid according to claim 7, wherein a battery is integrated in the housing.

9. A hearing aid according to claim 7, wherein the housing is watertight.

10. A method for switching a hearing aid on and off, comprising:

acquiring a resistance signal related to an electrical load resistance;

determining a value of the electrical load resistance based on a size of the volume into which the hearing aid emits sound, wherein a first size of the volume is defined upon insertion of the hearing aid into an auditory canal of an user wearing the hearing aid, and a second size of the volume is defined upon deinsertion of the hearing aid from the auditory canal of the user; and deriving a switching signal for automatically switching the hearing aid on and off from the resistance signal related to the electrical load resistance resulting upon insertion and deinsertion of the hearing aid relative to the auditory canal of the user.

11. The method according to claim 10, wherein the switching signal is further derived from an element chosen from the group consisting of a heat flow sensor for detecting a body heat of a hearing aid user, a pressure sensor for detecting a contact pressure of a housing of the hearing aid against an auditory canal of a hearing aid user, an acoustic sensor for detecting a sound level and a remote control for wirelessly transmitting a switching signal to the hearing aid.

12. The method according to claim 11, wherein a switch-on signal for switching on the hearing aid is generated based on a first threshold value and a switch-off signal for switching off the hearing aid is generated based on a second threshold value, the first and second threshold values related to a physical value associated with the element.

13. The method according to claim 10, wherein a switch-on signal for switching on the hearing aid is generated based on a first threshold value and a switch-off signal for switching off the hearing aid is generated based on a second threshold value, the first and second threshold values related to the electrical load resistance.

14. The method according to claim 10, wherein switching on and off the hearing aid by the switching device includes switching the hearing aid from an operating mode to a stand by mode and from a stand by mode to an operating mode.

15. The method according to claim 10, wherein switching on and off the hearing aid is based on a time signal.

* * * * *